US005548981A

United States Patent [19]

Kirk

[11] Patent Number: 5,548,981

[45] Date of Patent: Aug. 27, 1996

[54] LOCK ASSEMBLY FOR A PERSONAL COMPUTER SYSTEM ENCLOSURE

[75] Inventor: Richard D. Kirk, Lake Worth, Fla.

[73] Assignee: International Business Machines Corporation, Armonk, N.Y.

[21] Appl. No.: 332,024

[22] Filed: Oct. 31, 1994

[51] Int. Cl.[6] ..... E05B 69/00; E05B 15/16

[52] U.S. Cl. ..... 70/58; 70/422; 70/441; 70/370; 292/331

[58] Field of Search ..... 292/307 R, 308, 292/314, 316, 322, 323, 324, 327, 331; 70/DIG. 32, 58, 57, 368, 370, 379 R, 379 A, 451, 465, 422, 432, 439–441, DIG. 59; 312/223.2; 90/299; 361/683, 724–727, 680–686

[56] References Cited

U.S. PATENT DOCUMENTS

| | | | |
|---|---|---|---|
| 1,284,890 | 11/1918 | Greenleaf | 70/370 |
| 1,343,712 | 6/1920 | Eras et al. | 70/370 |
| 1,598,551 | 8/1926 | Brauning | 70/379 R |
| 2,018,574 | 10/1935 | Richter | 292/307 R |
| 3,209,569 | 10/1965 | Bryson et al. | 70/440 |
| 3,503,233 | 3/1970 | Russell et al. | 70/370 |
| 4,074,547 | 2/1978 | Seidewand | 70/1.5 |
| 4,178,783 | 12/1979 | Lee | 70/422 |
| 4,397,165 | 8/1983 | Licausi | 70/422 |
| 4,413,493 | 11/1983 | Meinsen et al. | 70/422 |
| 4,425,999 | 1/1984 | MacDonald et al. | 292/307 R |
| 4,426,858 | 1/1984 | Interrante | 70/1.5 |
| 4,685,317 | 8/1987 | DeWalch | 70/440 |
| 4,726,206 | 2/1988 | Hsu | 70/441 |
| 4,830,414 | 5/1989 | Davis | 292/327 |
| 4,850,657 | 7/1989 | Placke et al. | 312/213 |
| 4,890,006 | 12/1989 | Huang | 307/112 |
| 5,162,976 | 11/1992 | Moore et al. | 361/393 |
| 5,301,988 | 4/1994 | Davenport et al. | 70/432 |
| 5,417,012 | 5/1995 | Brightman et al. | 312/223.2 |

FOREIGN PATENT DOCUMENTS

| | | | |
|---|---|---|---|
| 1429235 | 3/1976 | United Kingdom | 272/307 R |

OTHER PUBLICATIONS

IBM Technical Disclosure Bulletin vol. 22, No. 3 Aug. 1979.

*Primary Examiner*—Darnell M. Boucher
*Attorney, Agent, or Firm*—Anthony N. Magistrale

[57] ABSTRACT

A lock assembly is disclosed for small computers and similar electronic devices of the type that must be locked yet must permit access for repair even when the proper key is not available to the repair person without requiring that the expensive lock or its mounting be damaged. Further, readily visible evidence of the forced access must be apparent to a casual observer of the computer. Forced entry detection is provided by the instant invention through the use of a fracture ring having support elements seated into recesses in a rebated cover opening which hold the lock assembly in place during normal use but which allow the assembly to become axially misaligned after the lock has been forced. Frangible portions of the lock support hold the lock assembly in both rotational and axial stability which stability is lost when the frangible portions are broken.

10 Claims, 7 Drawing Sheets

LOCK ASSEMBLY FOR A PERSONAL COMPUTER SYSTEM ENCLOSURE

BACKGROUND OF THE INVENTION

This invention relates to small computers and similar electronic devices of the type that must be locked to protect information stored therein as well as expensive components, yet must permit access for repair even when the proper key is not available to the repair person.

The use of a fracture ring to allow a locked personal computer to be opened for repair is known in the art in an IBM PS/2 (R) model 50 personal computer. This ring allows access when it is broken without destroying a more expensive lock or its mounting. However, the lock can be carefully rotated back into its original position and the forced entry will not be noted until an operator again unlocks the computer at which time the break in the parts of the ring that keeps the lock from turning may become apparent. The use of a master key in this application is impractical because a low cost master keyed lock that can be opened by any repair depot can also be opened by the stolen master key without any evidence of tampering.

U.S. Pat. No. 3,209,569 teaches a tamper indicating casing for locks. A second lock housing is provided which completely encloses the lock structure so that access to the lock can only be obtained by breaking a seal. Observers of the lock and housing will then know that access has been obtained to the lock operating structure. It is an expensive apparatus and requires that the fracturable part be replaced every time that the lock is opened.

U.S. Pat. No. 4,074,547 shows an automobile ignition switch containing frangible elements to frustrate forced disassembly of the lock by a thief such as by forcing a screw into the keyway and then pulling the cylinder out with the screw and a pry bar or impact hammer. In this prior art, the frangible elements cause the cylinder to separate and the part that remains in the vehicle is further detented into locked position and has no holes into which a screw or other tool could be forced. This teaching does not permit the access that is necessary into a personal computer that has been sent to a repair depot without a key.

U.S. Pat. No. 4,413,493 is directed to a frangible lock actuator for an automotive vehicle trunk which like 4,047,547 permits the cylinder to be forcibly extracted. This teaching leaves only a virtually ungraspable nub held into the lock by two spring washers in the nearly inaccessible cylinder opening. The nub shaft prevents use of a screw driver to then open the car trunk.

U.S. Pat. No. 4,426,858 is also similar to the above references in that access to the locked area is frustrated by a flexible link between the lock cylinder and the latch. When the cylinder is extracted or pushed in, the flexible link frustrates latch rotation and further, the latch actuator becomes disassembled preventing actuation of the latch.

U.S. Pat. No. 4,685,317 teaches a frangible plug which is inserted into a key hole to prevent insertion of a key. The plug has teeth and a frangible score line which allows an authorized person possessing a special tool to destroy and remove the plug as shown in FIG. 5 of this patent. A plug will not solve in the instant need for a lock that operates normally but can be forced by a repair person yet leaves clear evidence when forced by someone tampering with the computer.

U.S. Pat. No. 4,890,006 is a computer switch lock having a reset as well as off and on positions. It has no frangible elements and does not allow entry by a repair person without a key.

SUMMARY OF THE INVENTION

These problems of cost and forced entry detection are resolved by the instant invention through the use of a fracture ring having support elements which hold the lock assembly in place during normal use but which allow the assembly to become axially misaligned after the lock has been forced.

Accordingly it is an advantage of the invention that frangible portions of the lock support hold the lock assembly in both rotational and axial stability which stability is lost when the frangible portions are broken.

It is a further advantage of the invention that the opening in the cover of the device being protected is recessed to hold the frangible portions and to permit axial misalignment when the frangible portions are broken.

DESCRIPTION OF THE PREFERRED EMBODIMENT(S)

Figure 1:
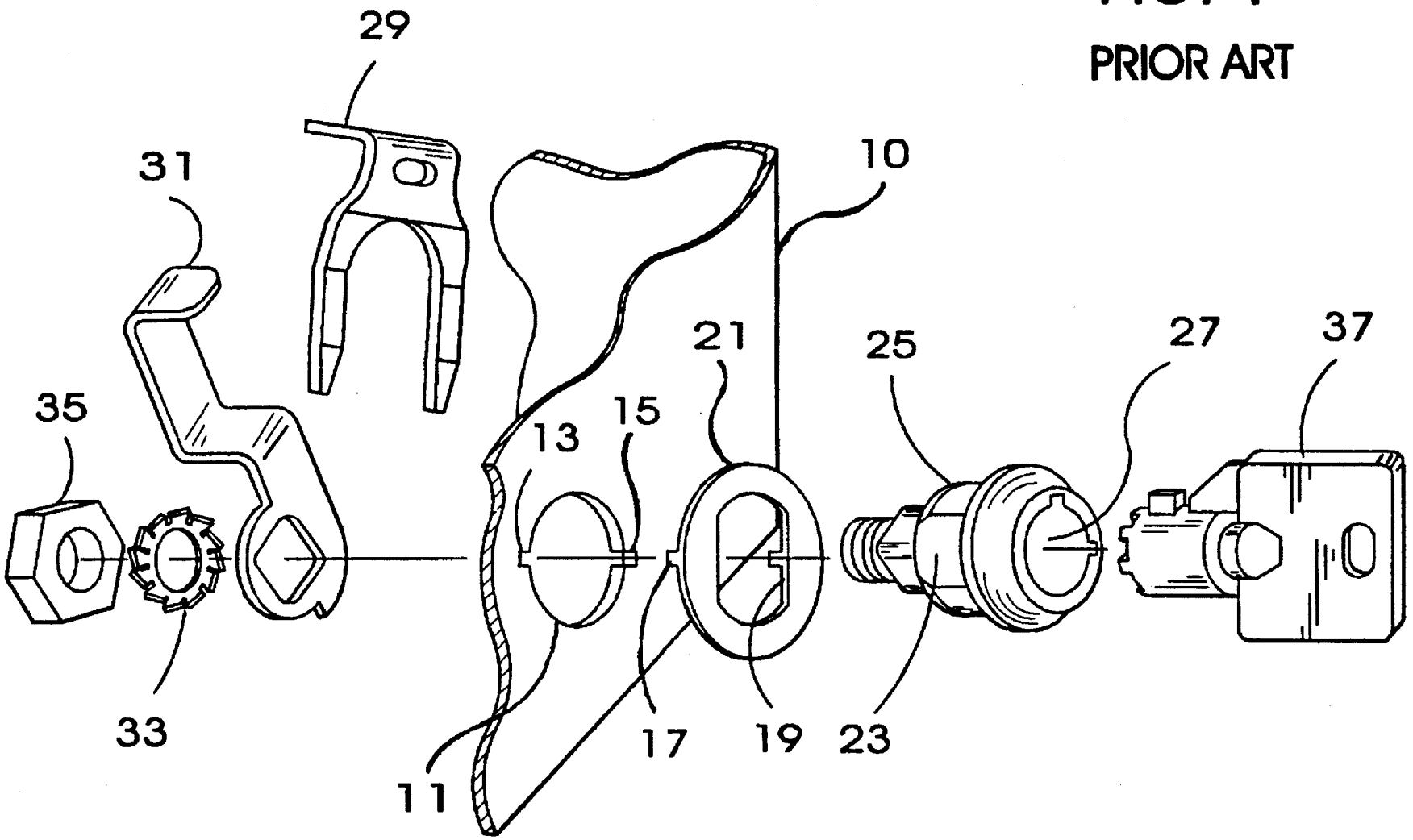
FIG. 1 PRIOR ART
FIG. 1 shows a prior art fracture ring and lock assembly.

FIG. 1 shows an example computer 10 of the prior art. An opening 11 is provided in the cabinet of computer 10. Opening 11 has a generally circular midsection with notches 13 and 15 provided at each side for engagement with tabs 17 and 19 respectively of low cost plastic ring 21. These notches and tabs prevent ring 21 from rotating once it has been assembled into opening 11.

Ring 21 also has a circular opening in its center with flattened sides defined by chords of the circular opening. The flattened sides are located adjacent to the tabs and engage the flats 23, one of which is hidden on the back side of lock housing 25. Housing 25 is held in place with ring 21 in opening 11 by a clip 29 which engages grooves, not shown, in housing 25. An actuator arm 31 is held onto lock cylinder 27 by a washer 33 and nut 35 in order to operate an electrical on/off switch, also not shown. When a proper key 37 is inserted into the lock it can turn the lock cylinder 27 to operate the switch normally, and by further rotation operate a cover latch, also not shown. If the proper key is not provided to a repair person, another key can be inserted and forcing torque applied to break off tabs 17 and 19 which will allow the whole assembly to rotate, operating the switch and by further rotation, the cover latch. After the cover is opened, the nut 35 is removed and a new low cost replacement ring 21 is used when reassembling the lock to the computer 10. There is no indication however that the tabs have been broken until one turns the key and finds that the whole lock rotates.

Figure 2A:
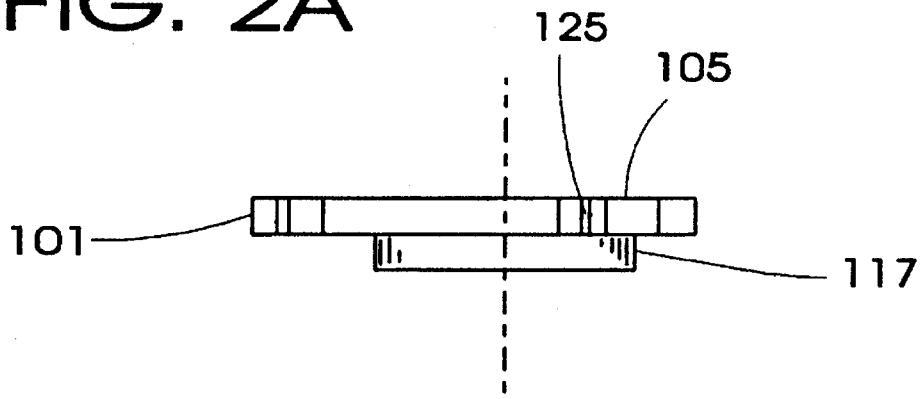
FIGS. 2A and 2B show a fracture ring for releasably supporting an on/off switch lock in accordance with the invention.
Figure 2B:
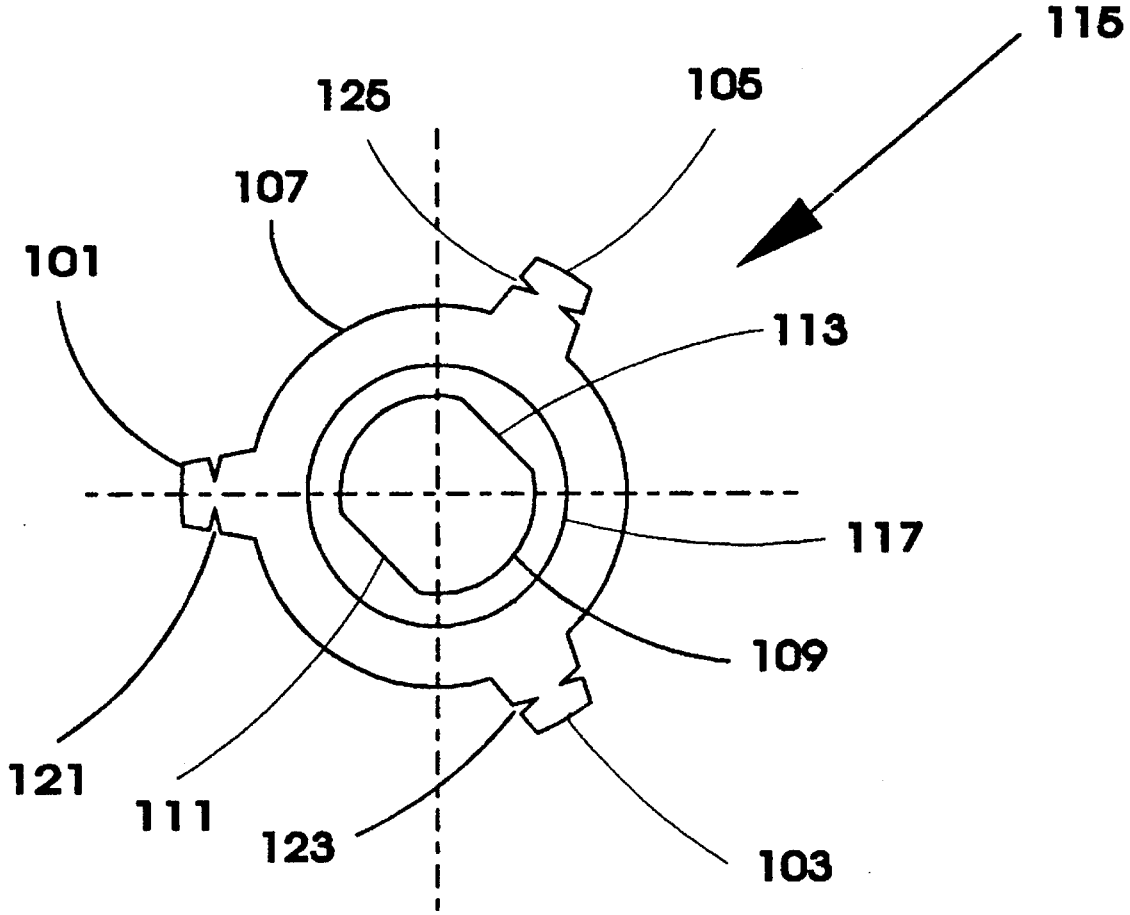

FIG. 2 shows a fracture ring 115 according to the invention. FIG. 2A is an edge view and FIG. 2B is a bottom view with no hidden lines being shown. The fracture ring 115 of the invention has a central circular opening 109 having the flattened sides 111 and 113 which engage flats in the housing of the lock to prevent rotation of the lock in the ring 115. The outer diameter 107 of the ring 115 has three lobes numbered 101, 103 and 105 which support the ring 115 along with the lock by fitting into three special cavities provided in the computer cover. The cavities are shown in detail in FIG. 4.

Each of the lobes 101 through 105 has a reduced section 121, 123 and 125 respectively that are designed to break if excessive torque is applied to the ring 115. These lobes are designed to allow the entire lock and ring 115 to move off center and to tip out of alignment to provide a visible indication when the lock has been breached. Flange 117 on fracture ring 115 provides a standoff between a spring clip and housing 25 which allows the axial position of the lock to be compromised when the fracture ring 115 lobes break without interference by the spring clip.

Figure 3:
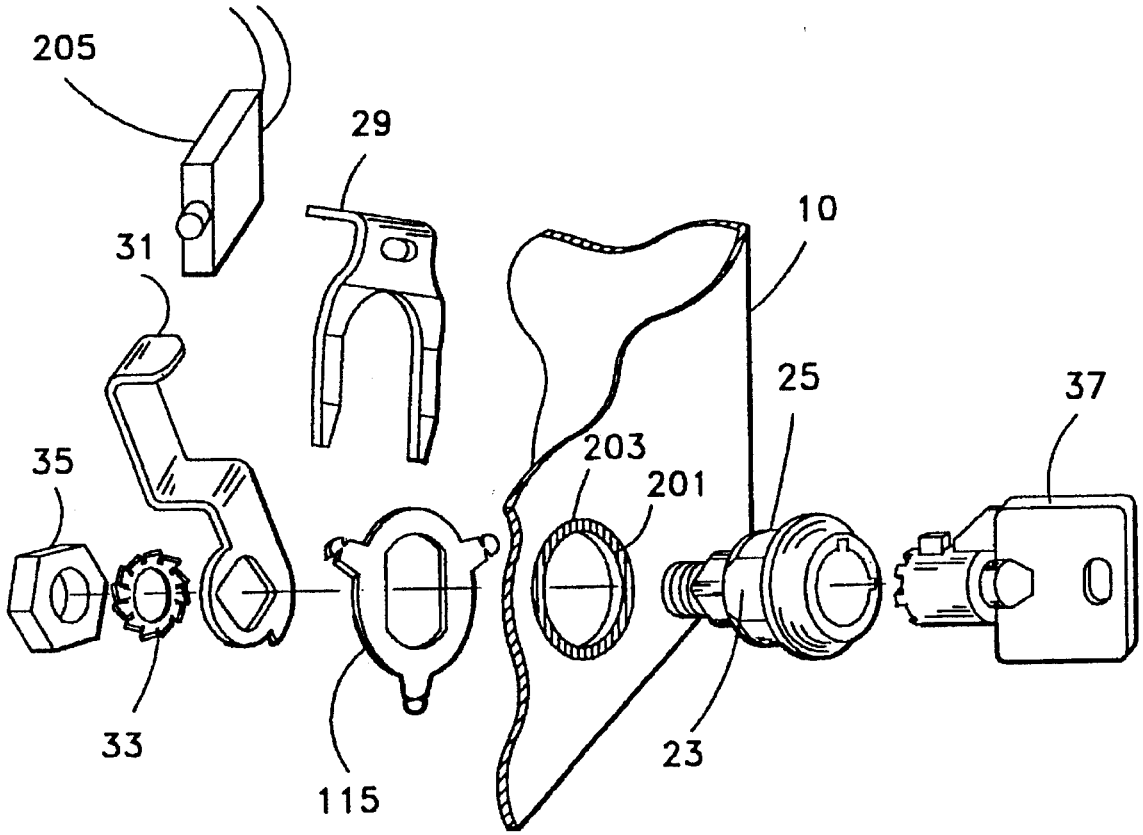
FIG. 3 is an assembly drawing of a lock and fracture ring in accordance with the invention.

FIG. 3 is an isometric assembly drawing which shows how the fracture ring 115 of the invention is assembled with the standard lock housing 25, clip 29, arm 31, washer 33 and nut 35. Arm 31 may operate a cover latch to lock the covers in place or may operate an electrical on/off switch such as switch 205. Unlike the prior art, in this preferred embodiment, the fracture ring 115 is inside of the cover 10 of the computer and the opening 201 in the cover 10 is larger than that of the prior art to allow the lock assembly to move off center and tip when the lobes are broken. Although a lock assembly hanging crooked in its mounting is a vivid indicator that something is wrong, attention can be heightened by providing a further indicator. In the preferred embodiment, an area 203 of contrasting color or surface texture is provided around opening 201. The color red is a good choice. During normal assembly, the flange portion of lock housing 25 either completely covers or is centered in the area 203 indicating to an observer that the lock assembly is intact. When the fracture ring 115 is broken and the housing 25 moves to a noncentral position, the area 203 is exposed such that the noncentral location of housing 25 is immediately apparent to an observer.

Figure 4A:
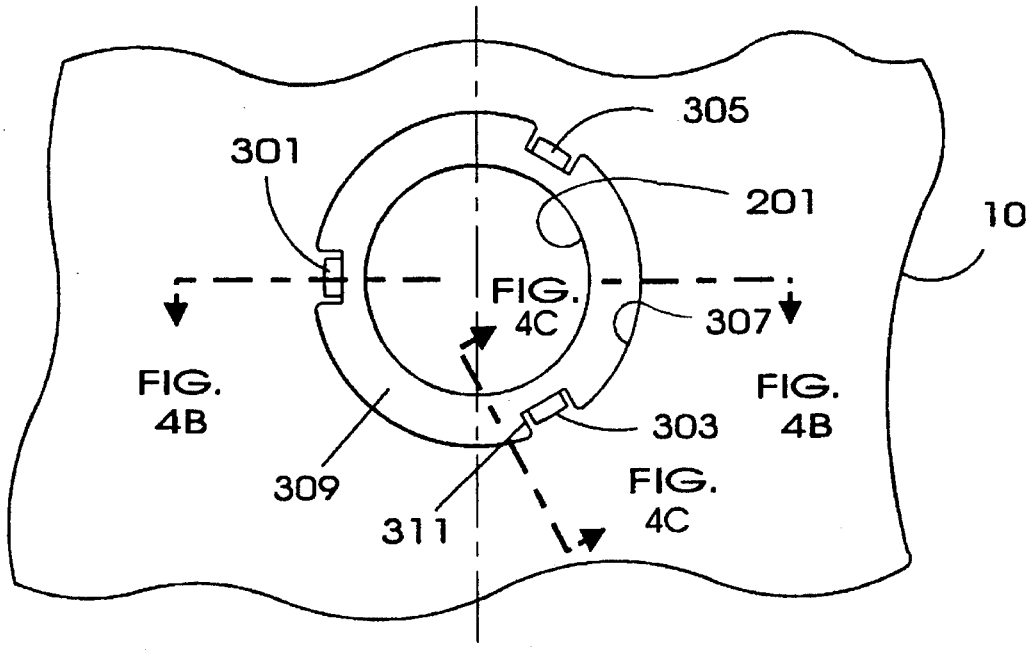
FIGS. 4A, 4B and 4C show details of an opening in a computer cover according to the invention for supporting a fracture ring of the invention.
Figure 4B:
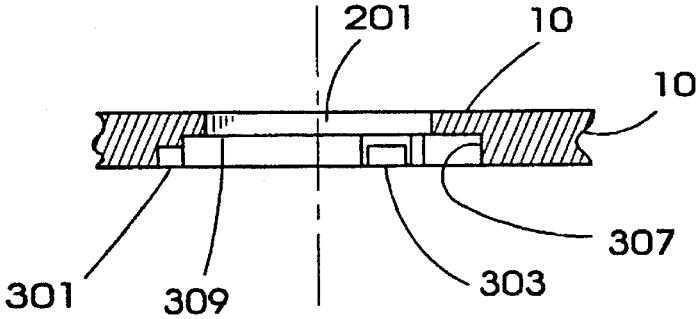
Figure 4C:
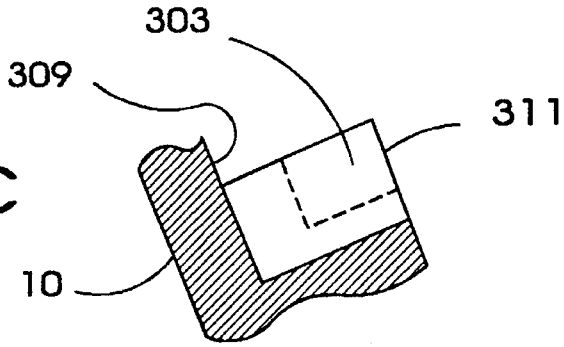

FIG. 4 comprising FIGS. 4A, 4B, and 4C show the details of the opening in cover 10 which are not shown in FIG. 3. FIG. 4A is a view from the inside of the cover toward the outside showing the cover itself broken away at 10. The opening 201 which is also shown in FIG. 3 appears in the center of the FIG. 4A. Concentric with opening 201, a circular area or rebate 307 has been molded into cover 10. The rebate 307 holds the lobes of ring 115. In their normal unbroken position, the lobe ends 101, 103, and 105 lie in recesses 301, 303, and 305, also molded into the cover 10. The recesses 301 to 305 are not quite as deep as the rebate 307 and they hold the ring 115 out away from the bottom 309 of rebate 307. Two of these recesses 301 and 303 are shown in the edge section of FIG. 4B where the lessor depth is more readily apparent. The remaining numerals in FIG. 4B also correspond to those in FIG. 4A. FIG. 4C is another section view, this time of lip 311 forming one side wall of recess 303. Again the depth of the bottom 309 of rebate 307 is deeper than the recess 303.

Figure 5B:
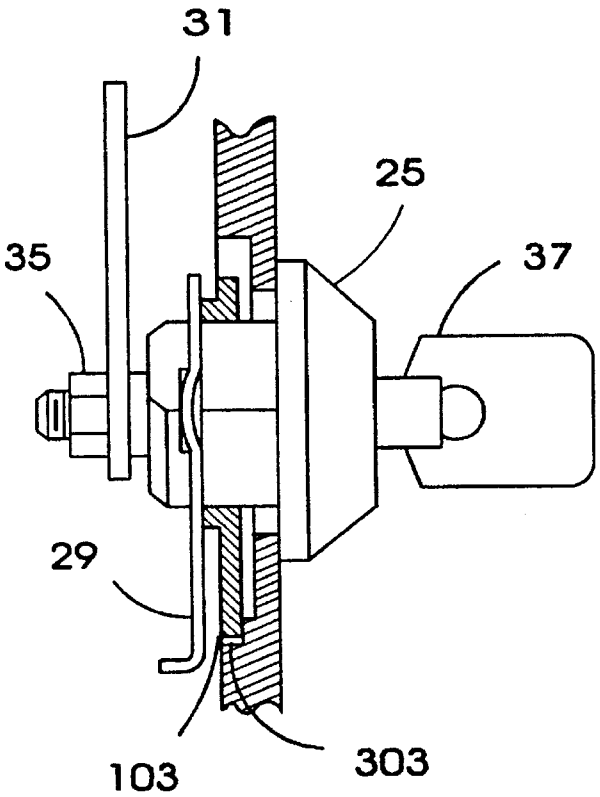
FIGS. 5A and 5B show how a lock is installed with the invention.
Figure 5A:
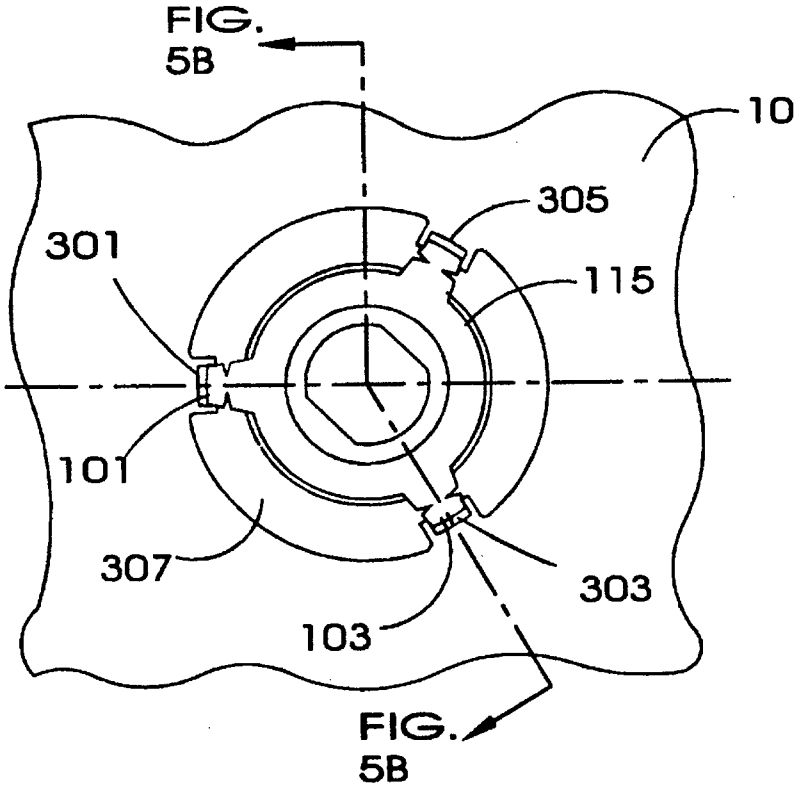

FIG. 5A shows an end view of fracture ring 115 from the same side as shown in FIG. 2, ring 115 being seated into its three support recesses 301, 303, and 305 in the cover 10. FIG. 5B is a section view along the section line of FIG. 5A of the fracture ring 115 seated in the recesses, only 303, showing in this figure. Other parts of the lock including housing 25, clip 29, arm 31 and nut 35 are also shown in this view. Lobe 103 is shown seated in recess 303 with a key 37 installed in the lock which is assumed not to be a proper key so that the lock cylinder will not turn in the lock housing 25.

Figure 6B:
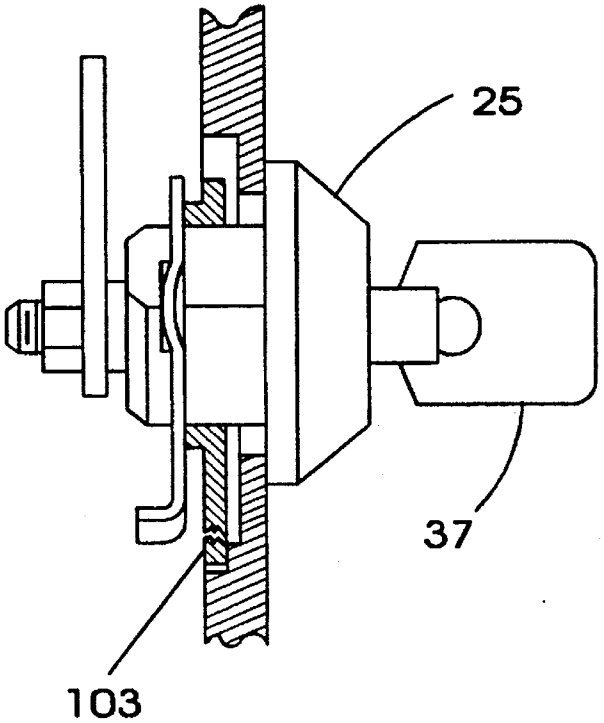
FIGS. 6A and 6B show the lock assembly as it is being forced.
Figure 6A:
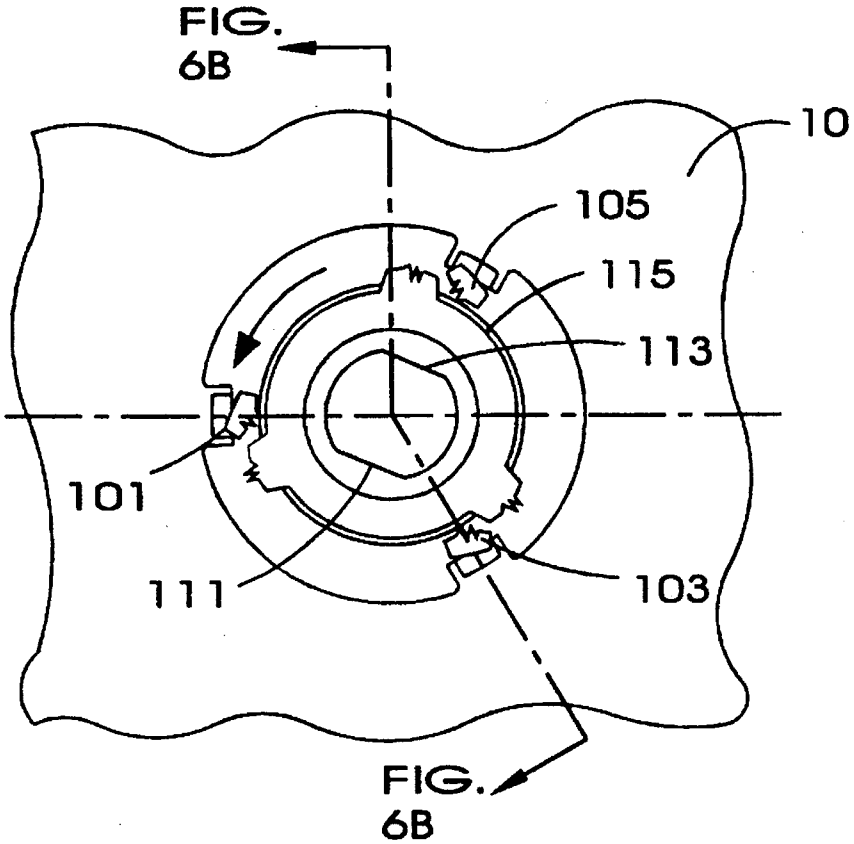

FIG. 6A is the same end view as is FIG. 5A but in FIG. 6A, sufficient torque has been applied to the improper key so that the whole lock housing was caused to rotate counter clockwise breaking off lobes 101, 103, and 105. These lobes broke because the housing was positively engaged to fracture ring 115 by the flats 111 and 113. Lobe 103 is shown slightly offset from fracture ring 115 in the section view of 6B because the lock has not only begun to turn but has moved ever so slightly back out of the opening in cover 10.

Figure 7B:
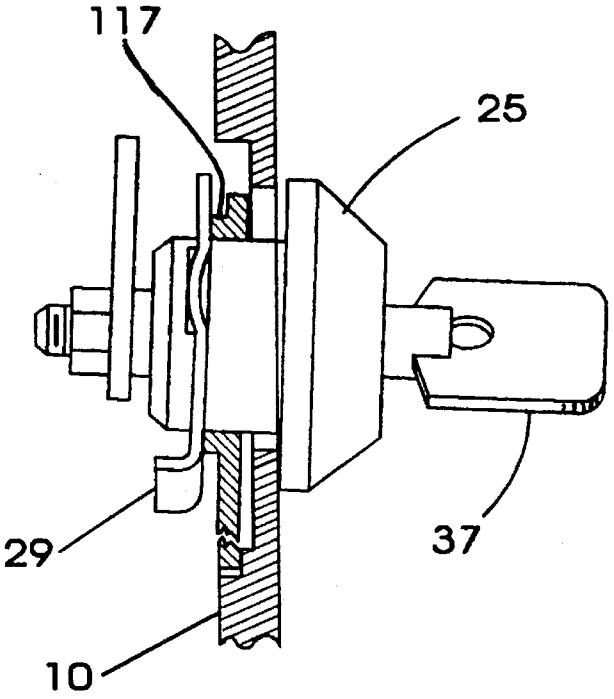
FIGS. 7A and 7B show the lock assembly of the invention after forced entry.
Figure 7A:
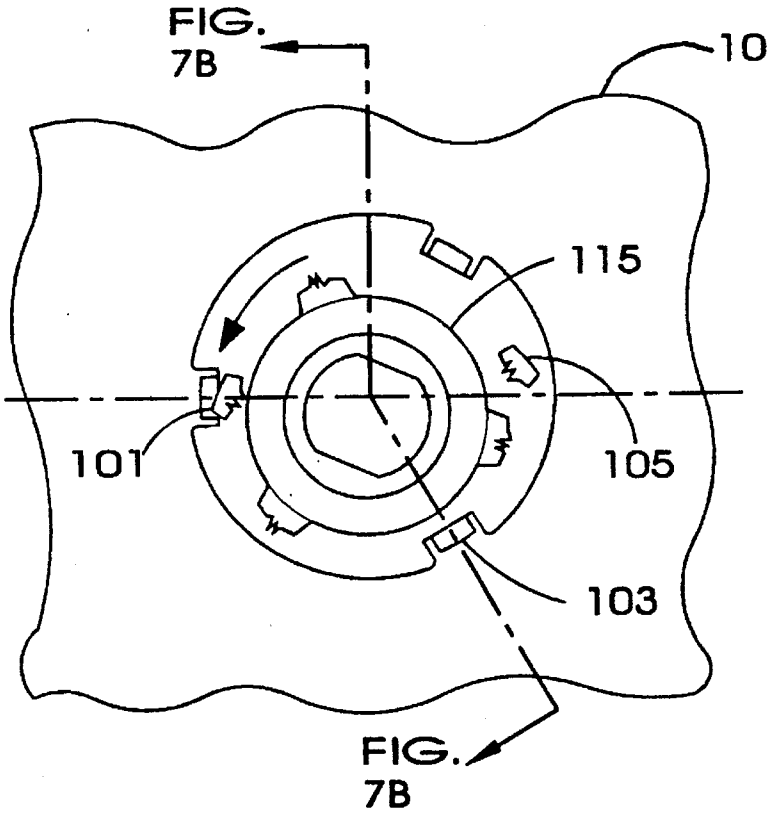

In FIG. 7A the same end view again appears but this time the lock has rotated about thirty degrees causing the lobe end 105 to fall free and the ring 115 to not only turn but also drop down and completely out of its mounting recesses. The lock housing 25 has dropped down with the fracture ring 115 and has become very loose axially ending up crooked in the opening in cover 10. This change of position of the lock is shown more clearly in FIG. 7B and it will likewise be readily apparent to a casual observer that the lock has been forced. The flange 117 on fracture ring 115 provides a standoff between the spring clip 29 and housing 25 which allows the axial position of the lock to be compromised when the fracture ring 115 lobes break. The lock assembly can not be restored to its normal position without disassembly and replacement of the fracture ring 115. It will be clear to those of skill in the art that other types and forms of locks can be mounted using a fracture ring according to the invention. Further, the number and placement of the supporting members which in the preferred embodiment are the three lobes, can be changed so long as their breakage causes axial misalignment of the lock assemble which is visually apparent to an observer of the lock assembly without physical manipulation of the lock. For example the three lobes of the preferred embodiment could be connected together with another ring so that the fracture ring would separate into only two parts when excessive torque is applied.

Having described the invention in terms of a preferred embodiment thereof, it will be recognized by those skilled in the art of computer equipment design that various additional changes in the structure and operation of the implementation described can be made without departing from the spirit and scope of the invention which is measured by the following claims.

What is claimed is:

1. A lockable computer comprising:

an opening in said computer for receiving a lock housing, said lock housing having a cylindrical opening;

a lock cylinder rotatable in said cylindrical opening of said housing, said lock cylinder having locking elements engaging said cylinder and said housing to hold said cylinder from rotation in said housing and to allow rotation in said housing only when a proper key is inserted into said cylinder;

a fracture ring having a computer engaging part and a housing engaging part to hold said housing in a substantially central position in said opening in said computer;

said fracture ring having a weakened computer engaging part which breaks when excessive torque is applied to an improper key in said cylinder allowing said housing to rotate with said cylinder to unlock said computer without said proper key, said computer engaging part having a plurality of lobes, each of said lobes extending radially from an outer perimeter of said fracture ring and each lobe having a reduced cross section designed to break when excessive torque is applied to said improper key;

said opening in said computer having a rebated area which is concentric with said opening and allows said fracture ring and said lock to move to a position in said opening when said fracture ring has been broken so as to make it apparent to an observer that said computer engaging part has been broken.

2. The computer of claim 1 wherein said opening in said computer further comprises a plurality of recesses, at least three of said lobes being seated in three of said recesses to hold said fracture ring out away from said rebated area so as to allow said lock to tip out of axial alignment providing a visual indication that said lock has been forced.

3. The computer of claim 2 wherein said rebated area in said opening is of adequate diameter to allow said lock to drop down out of alignment with said opening whereby a visual indication is provided to indicate to an observer that said lock has been forced.

4. The computer of claim 1 further comprising an arm connected to said lock cylinder, said arm rotating with said cylinder to engage an on/off switch whereby said lock controls operation of said computer.

5. An electronic device and lock assembly comprising:

a cover containing said device, said cover having an opening into which a lock is held in a normal position by a fracture ring;

said opening in said cover having a recess for receiving a positioning portion of said fracture ring;

said positioning portion of said fracture ring being attached to a lock holding portion of said fracture ring by a reduced cross section, said reduced cross section providing a breaking portion which breaks when excessive torque is applied to said lock, said positioning portion having a plurality of lobes, each of said lobes extending radially from an outer perimeter of said fracture ring and each lobe having said breaking portion;

said opening in said cover having a rebated area which is concentric with said opening and allows said fracture ring and said lock to move to a position in said opening when said fracture ring has been broken so as to make it apparent to an observer that said breaking portion has been broken.

6. The lock assembly of claim 5 wherein each of said lobes being seated in a recess in said cover to hold said ring and lock in a normal position in said opening, whereby said lock is held in said normal position in said opening until said breaking portion has been broken.

7. The lock assembly of claim 5 wherein said cover further comprises an indicator area at said opening, said indicator area being uniformly covered by said lock in the normal position of said lock, said indicator area becoming non-uniformly uncovered by said lock when said reduced cross section has been broken.

8. The lock assembly of claim 7 wherein said indicator area is completely covered by said lock in said normal position of said lock.

9. A lockable computer comprising:

an opening in said computer for receiving a lock housing, said lock housing having a cylindrical opening;

a lock cylinder rotatable in said cylindrical opening of said housing, said lock cylinder having locking elements engaging said cylinder and said housing to hold said cylinder from rotation in said housing and to allow rotation in said housing only when a proper key is inserted into said cylinder;

a frangible ring having a computer engaging part and a housing engaging part to hold said housing in a substantially central position in said opening in said computer;

said frangible ring having a weakened computer engaging part which breaks when excessive torque is applied to an improper key in said cylinder allowing said housing to rotate with said cylinder to unlock said computer without said proper key, said computer engaging part having a plurality of lobes, each lobe having a reduced cross section designed to break when excessive torque is applied to said improper key;

said opening in said computer having a rebated area which allows said frangible ring and said lock to move to a position in said opening when said frangible ring has been broken so as to make it apparent to an observer that said computer engaging part has been broken;

said opening in said computer having a plurality of recesses, at least three of said lobes being seated in three of said recesses to hold said frangible ring out away from said rebated area so as to allow said lock to tip out of axial alignment providing a visual indication that said lock has been forced.

10. The computer of clam 9 wherein sad rebate in said opening is of adequate diameter to allow said lock to drop down out of alignment with said opening whereby a visual indication is provided to indicate to an observer that said lock has been forced.

* * * * *